United States Patent [19]

Salukvadze

[11] 4,033,204

[45] July 5, 1977

[54] METHOD OF MAKING ROTARY CUTTERS

[76] Inventor: Viktor Samsonovich Salukvadze, 5 Parkovaya ulitsa 42, kv. 53, Moscow, U.S.S.R.

[22] Filed: Aug. 12, 1975

[21] Appl. No.: 604,075

[52] U.S. Cl. ..... 76/101 A

[51] Int. Cl.[2] ..... B21K 5/12

[58] Field of Search ..... 76/101 A, 101 R; 300/21; 15/198

[56] References Cited

UNITED STATES PATENTS

| | | | |
|---|---|---|---|
| 2,349,643 | 5/1944 | Wesemeyer | 15/198 X |
| 2,739,332 | 3/1956 | Flohr | 15/198 |
| 3,449,784 | 6/1969 | Moss | 300/21 X |
| 3,583,020 | 6/1971 | Bateman | 15/198 |

FOREIGN PATENTS OR APPLICATIONS

| | | | |
|---|---|---|---|
| 820,,889 | 7/1949 | Germany | 15/198 |

*Primary Examiner*—James L. Jones, Jr.
*Assistant Examiner*—Nicholas P. Godici

[57] ABSTRACT

A method for manufacturing rotary cutters of the brush milling-cutter type comprising corrugating a wire to produce a blank in which the height of each corrugation is at least equal to the length of a resilient member-to-be of the cutter, the spacing between adjacent corrugations being less than the diameter of the wire, and assembling the thus produced blanks into a stack in which the corrugations extend perpendicularly to the longitudinal axis of the cutter.

3 Claims, 4 Drawing Figures

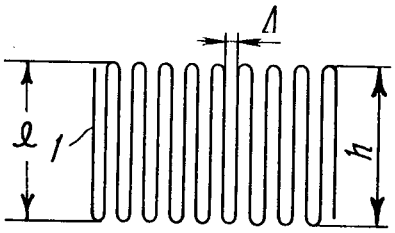
FIG. 1
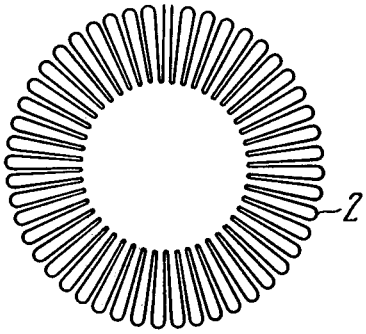
FIG. 2
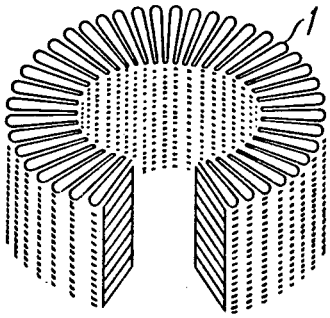
FIG. 3
FIG. 4
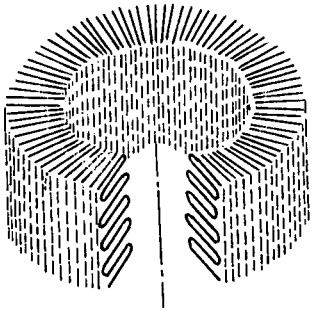

METHOD OF MAKING ROTARY CUTTERS

The present invention relates to the working of surfaces of articles and materials and, more particularly, it relates to methods of manufacturing rotary cutters of the brush milling-cutter type.

The disclosed method can be utilized to utmost effectiveness for manufacturing rotary cutters of the brush milling-cutter type, wherein the factor of filling the working periphery of the cutter with the faces of resilient members is within a range from 0.05 to 0.7.

At present, there are known methods of manufacturing a brush-type rotary milling-cutter, comprising assembling pre-indexed resilient members in the form of wire lengths into a stack, then joining these members to one another by pressing them and securing the non-working ends of the members together.

The hitherto known method can be used for making brush-type rotary milling-cutters with uniform distribution of the faces of the free ends of the resilient members over the working surface, the factor of filling this surface being from 0.7 to 0.99 with the diameter of the cutter below 300 mm, and with this factor being from 0.6 to 0.99, when the cutter diameter is in excess of 300 mm.

The above cutters can be used for working materials having the physical properties approximating those of carbon steels, to Standard Class 5 finish. To operate on more viscous and ductile materials such as copper and aluminum, there are required brush-type rotary cutters with a filling factor from 0.05 to 0.7; however, the hitherto known methods have proved incapable of making such brush-type rotary cutters with uniform distribution of the faces of the free ends of the resilient members over the working surface.

This may be explained by the fact that when the resilient members are assembled into a stack according to the hitherto known method, the free ends filling the working surface are at a greater diameter of the rotary cutter, than the secured non-working or internal ends. The working ends of the resilient member tend, under the action of their own weight, to distribute themselves in the stack in an arbitrary manner, e.g. to be more dense in the lower layers and less dense in the upper ones, i.e. they are non-uniformly distributed along the height of the stack.

It is an object of the present invention to provide a method for making a rotary cutter of the brush milling-cutter type, which will ensure substantially uniform distribution of the faces of the free ends of the resilient members over the working surface, with the factor of filling of this surface being from 0.05 to 0.7.

These and other objects are attained in a method of making rotary cutters of the brush- milling-cutter type, comprising assembling pre-indexed resilient members made of wire into a stack, pressing the stack and securing the non-working ends of the resilient members, in which method, in accordance with the present invention, there are employed the steps of corrugating a wire to obtain a blank in which the height of each corrugation is either equal to or in excess of the calculated length of the resilient member to be made, the spacing between adjacent corrugations being less than the diameter of the wire, assembling the thus produced blanks into a stack wherein the corrugations extend perpendicularly to the longitudinal axis of the cutter and, following the pressing and securing of the non-working ends, cutting off the faces of the free ends to obtain a working surface of the brush-type milling-cutter with a filling factor from 0.05 to 0.7.

The herein disclosed method ensures uniformity of the distribution of the free ends of the resilient members over the working surface of the cutter. This is attained in that the spacing of the corrugations in every blank is pre-selected and predetermined, and with the blanks assembled into a stack and pressed, this spacing does not vary.

To manufacture brush-type milling-cutters with diameters less than 300 mm, it is expedient, according to a feature of the present invention, that each blank is curled into the shape of a flat ring, the opposite ends of the blanks being together, and in this shape the blanks are placed into the stack.

According to another feature of the present invention, it is expedient for the blanks to be assembled into a stack so that the axis of the cutter is in the plane of the blank.

For the present invention to be better understood, there follows hereinbelow a description of its embodiments and examples, with reference being had to the accompanying drawings, wherein:

FIG. 1 illustrates a blank of a cutter to be made;

FIG. 2 illustrates a blank curled into a flat ring;

FIG. 3 illustrates a stack assembled from the blanks; and

FIG. 4 illustrates another embodiment of a stack assembled from the blanks.

Referring to the drawings, the essence of the present invention resides in that a wire 1 (FIG. 1) of diameter $d$ is corrugated to obtain a blank in which the height $h$ of each corrugation is at least equal to the pre-calculated length $l$ of the resilient member-to-be, and the spacing $\Delta$ between adjacent corrugations is less than the diameter of the wire. The thus obtained blanks are assembled into a stack by any suitable known method, for examples, such that the corrugations extend perpendicularly to the axis of the cutter to be made, as can be seen in FIG. 3. Then the stack of the blanks is shaped by pressing, and the non-working or internal ends of the resilient members are secured together; the end faces of the free or working ends of the resilient members are cut off to produce the working surface or periphery of the final cutter. The spacing $\Delta$ of the adjacent corrugations having been pre-selected and predetermined, there is ensured uniform distribution of the end faces of the free or working ends of the resilient members over the working surface of the cutter, with the specified factor of filling this surface being within a range from 0.05 to 0.7.

When making brush-type milling-cutters with diameters less than 300 mm, prior to a blank being placed into a stack, it is curled in advance into a flat ring 2 (FIG. 2), the ends of the blank are secured together in any suitable known manner, whereafter the blank is placed into the stack, as shown in FIG. 3.

EXAMPLE 1

Let us presume that a brush-type milling-cutter is to be made with the diameter of its working surface or periphery $D = 300$ mm, the length $l$ of the resilient members being approximately. $\approx 50$ mm and the wire diameter being $d = 0.6$ mm.

By corrugation there is produced a blank with any adjacent pair of the corrugations spaced by $\Delta = 0.5$ mm; then the pitch $t$ of the corrugations equals $t = d + \Delta = 0.6 + 0.5 = 1.1$ mm.

From the continuous corrugated strip, there are cut off blanks of length L which is determined from the following:

a. with the corrugated blank curled into the shape of a ring, the non-working ends of the corrugations to be secured together adjoin each other, and the side surfaces of the wires of the adjacent corrugations contact one another, which means that the pitch $t_1$ at this area of the non-working ends equals the diameter of the wire, i.e., $t_1 = d = 0.6$ mm, whereas the pitch in the bent end of each corrugation remains the same, i.e., $t = 1.1$ mm. Consequently, the average pitch $t_{av}$ at the non-working surface of the cutter is:

$$t_{av} = \frac{t + t_1}{2} = \frac{1.1 + 0.6}{2} = 0.85 \text{ mm.}$$

The diameter $D_1$ of the circumference of the non-working surface of the cutter, i.e. at the side of the secured ends of the resilient members is:

$$D_1 = D - 2l = 300 - 2.50 = 200 \text{ mm.}$$

This circumference with the diameter $D_1$ accommodates the following amount of the corrugations:

$$\frac{\pi \cdot D_1}{t_{av}} = \frac{\pi \cdot 200}{0.85} = 740 \text{ corrugations.}$$

In the free state of the blank the spacing of the resilient members, i.e. the pitch of the corrugations equals 1.1 mm, whereby the length of the blank equals $L = 740 \,.\, 1.1 \approx 815$ mm.

The blanks of this length are curled into a flat ring, and the opposite ends of the blank are secured together, whereafter such rings are placed one on top of another to assemble them into a stack.

The non-working ends of the stack are then shaped by pressing and secured together in a suitable known manner.

In the presently described example the factor $\phi$, of filling the space at the non-working ends i.e. the area of the wires to the total area of the cutter surface, is $$\phi_1 = \frac{\pi \cdot d^2}{4} : t_{av} d_1 \text{ or } \phi_1 = \frac{\pi \cdot d}{4\, t_{av}} = \frac{1.88}{3.4} = 0.55$$

whereas the factor $\phi$ of filling the working surface of the cutter at the face ends of the resilient members is calculated from the following known expression:

$$\pi \cdot D \cdot B \cdot \phi = \pi \cdot D_1 \cdot B_1 \cdot \phi_1$$

wherein $B$ is the width of the stack at the working surface of the cutter, $B_1$ is the width of the stack at the non-working surface of the cutter.

With $B = B_1$, $D\phi = D_1\phi_1$, whereby $$\phi = \phi_1 \,.\, \frac{D_1}{D} = 0.55 \cdot \frac{200}{300} = 0.366$$

Should it be necessary to produce a cutter which is less dense, i.e. which has a smaller surface-filling factor, the corrugated blank is made correspondingly shorter than the above described pre-calculated value. The flat rings obtained from such shorter blanks, naturally, tend to have a correspondingly smaller diameter, and thus they have to be expanded circumferentially prior to their being assembled in the stack, for the diameter of the circumference of the non-working surface to remain the same, i.e. 200 mm in the presently described example. In this expanded form the rings are assembled into the stack, their non-working ends are pressed and secured. Thus, with the above dimensions D and $l$ remaining the same, the length of the blank is 300 mm instead of 740 mm, the spacing of the adjacent resilient members at the side of the non-working ends, instead of shortening as it has been described hereinabove increases by the value of the ratio 740:300, to constitute $1.1 \,.\, (740:300) = 2.7$ mm, whereby the average pitch $t_{av}$ equals:

$$t_{av} = \frac{1.1 + 2.7}{2} = 1.9 \text{ mm.}$$

The surface-filling factor at the side of the non-working ends which are secured together, is as follows:

$$\phi_1 = \frac{\pi\, d^2}{4} \cdot t_{av} \cdot d = \frac{\pi \cdot d}{4\, t_{av}} = \frac{\pi \cdot 0.6}{4 \cdot 1.9} \approx 0.25$$

Consequently, the filling factor at the side of the free working ends equals $$\phi = 0.25 \frac{200}{300} = 0.167.$$

EXAMPLE 2

For brush-type milling-cutters being made by the herein disclosed method of diameters in excess of 300 mm, the calculations are preferably performed in the following simplified manner:

let us presume that a brush-type milling-cutter of a diameter equalling 600 mm is to be manufactured with the width of the working surface or periphery being $B = 500$ mm, from wire stock 1.0 mm in diameter, the length of the resilient members being $l = 100$ mm. According to the invention, the spacing of the adjacent corrugations is to be less than the diameter $d$ of the wire stock of which the resilient members are being made, i.e. $\Delta < d$.

Let us take $\Delta = 0.8$, $d = 1.0$ mm, then the pitch $t$ of the corrugations equals $t = 1.0 + 0.8 = 1.8$ mm.

From the continuous corrugated strip there are cut off blanks with the length L equalling the width of the cutter to be made, i.e. $L = 500$ mm. These blanks are placed so that the axis of the cutter is in the plane of the blank, and the corrugations extend perpendicularly to this axis. FIG. 4 shows this arrangement.

In this case the factor $\phi_1$ of filling the space from the side of the non-working ends equals:

$$\phi_1 = \tfrac{3}{4}\pi d^2 : (2t + d) d \cos 30^\circ = \tfrac{3}{4}\pi \cdot l : (2 \cdot 18 + 1) \cdot 1 \cdot 0.866 = 0.59.$$

while the factor $\phi$ of filling the working surface at the side of the working ends is determined from the following known expression:

$$\phi = \phi_1 \frac{D_1}{D} = \frac{D - 2l}{D} \cdot \phi = \frac{600 - 2 \cdot 100}{600} \cdot 0.59 = 0.394$$

We claim:

1. A method of making a rotary cutter, comprising corrugating a wire, which is to subsequently form a resilient member of the rotary cutter, to obtain a blank, each corrugation having a height at least equal to the length of a resilient member, adjacent corrugations being spaced apart a distance less than the diameter of said wire, placing the blanks thus obtained in an indexed position into a stack so that the corrugations extend perpendicularly to the longitudinal axis of rotation of the cutter and the blanks define outer working ends and inner non-working ends, subsequently pressing the resilient members, securing the non-working ends of the resilient members together and cutting off the outer ends of the resilient members to form the working surface of the cutter, the factor of filling of the working surface with said outer ends being within 0.05 to 0.7.

2. A method as claimed in claim 1, comprising curling each blank into the shape of a flat ring and securing the ends of the blank together before placing the blank into the stack.

3. A method as claimed in claim 1, wherein the blanks are placed into the stack so that the axis of the cutter is in the plane of the blanks.

* * * * *